United States Patent [19]

Gjerde et al.

[11] 4,234,270

[45] Nov. 18, 1980

[54] MARINE STRUCTURE

[75] Inventors: Trygve Gjerde; Kjell Vigander, both of Jar; Dag N. Jenssen, As; Bjorn Hjertås, Sandefjord, all of Norway

[73] Assignee: A/S Hoyer-Ellefsen, Oslo, Norway

[21] Appl. No.: 597

[22] Filed: Jan. 2, 1979

Related U.S. Application Data

[63] Continuation-in-part of Ser. No. 964,964, Nov. 20, 1978, abandoned, which is a continuation of Ser. No. 829,133, Aug. 30, 1977, abandoned.

[51] Int. Cl.[3] ..... E02B 17/02

[52] U.S. Cl. ..... 405/202; 52/223 R; 405/203; 405/207

[58] Field of Search ..... 405/195, 202, 203, 205, 405/207, 210; 52/223 R, 633, 722

[56] References Cited

U.S. PATENT DOCUMENTS

| | | | |
|---|---|---|---|
| 2,187,871 | 1/1940 | Voorhees | 405/205 X |
| 2,414,011 | 1/1947 | Billner | 52/223 R X |
| 3,708,987 | 1/1973 | Roulet et al. | 405/210 |
| 3,720,066 | 3/1973 | Vilain | 405/202 |
| 3,793,842 | 2/1974 | Lacroix | 405/210 |

OTHER PUBLICATIONS

*Engineering News Record*, May 10, 1973, p. 39.

*Primary Examiner*—David H. Corbin
*Attorney, Agent, or Firm*—Larson, Taylor and Hinds

[57] ABSTRACT

A marine structure includes a base which is to be founded upon the sea bed. An elastic pre-stressed column is rigidly fixed to and extends upwardly from the base. A buoyant, rigid structure is fixed to the upper end of the upstanding elastic column. The buoyant, rigid structure includes a submerged part and a part projecting up above the sea level to support a deck superstructure. The pre-stressed elastic column is designed to deflect in a curved manner when the buoyant, rigid structure is subjected to environmental forces. In particular, the first nautral period of the installed structure is longer than the significant exciting wave periods. Accordingly, the main structure will oscillate about its vertical equilibrium when subjected to waves and wind thereby behaving as an articulated column.

8 Claims, 16 Drawing Figures

Figure 10:
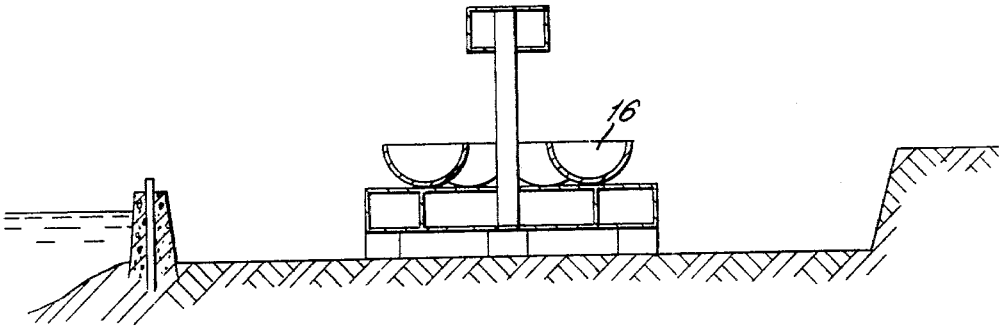

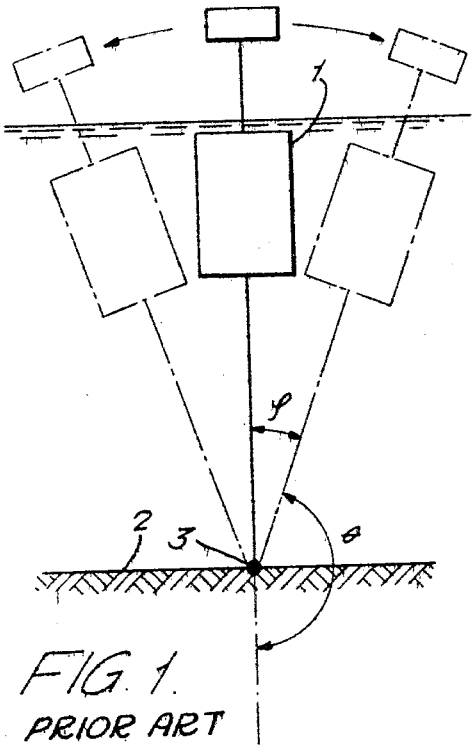
FIG. 1.
PRIOR ART
FIG. 2.
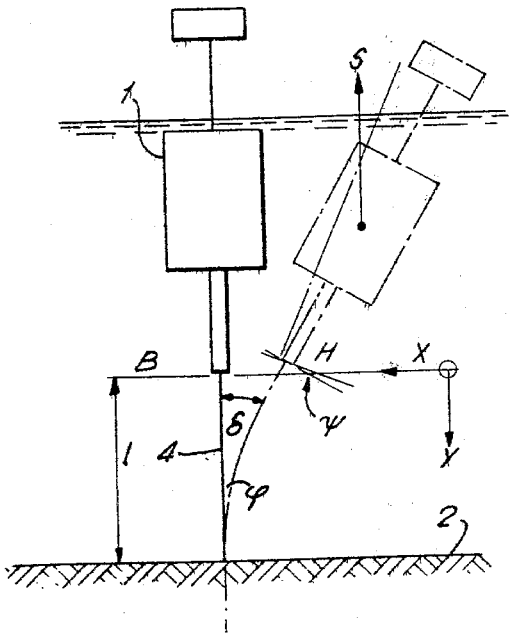
FIG. 3.
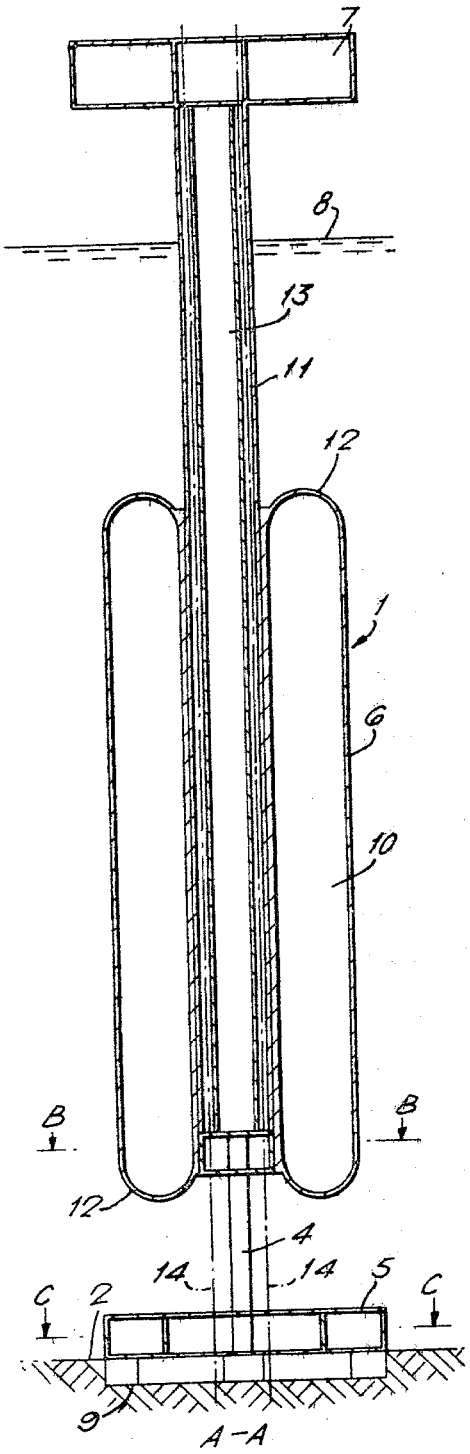

FIG. 4
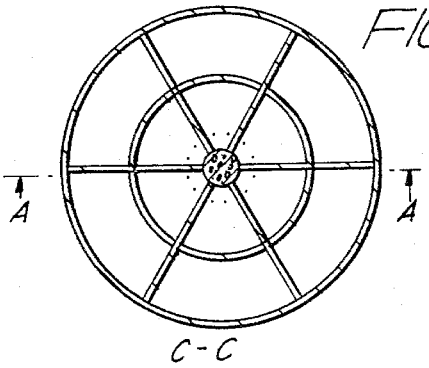
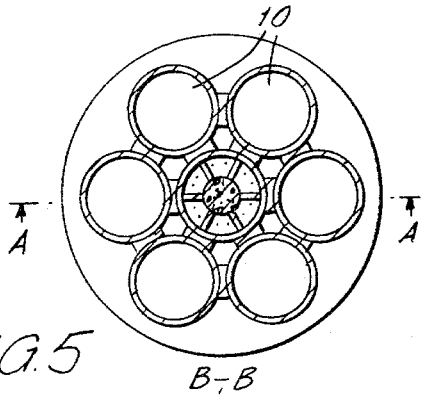
FIG. 5
FIG. 6
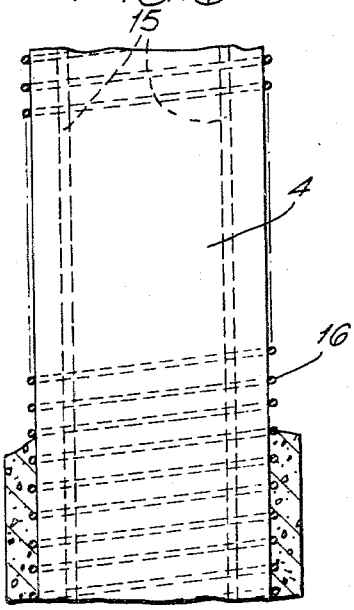
FIG. 7
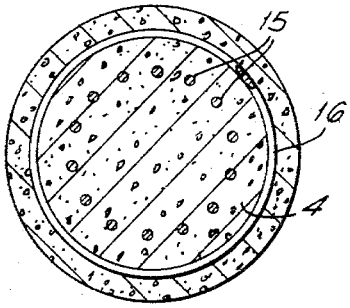
FIG. 8
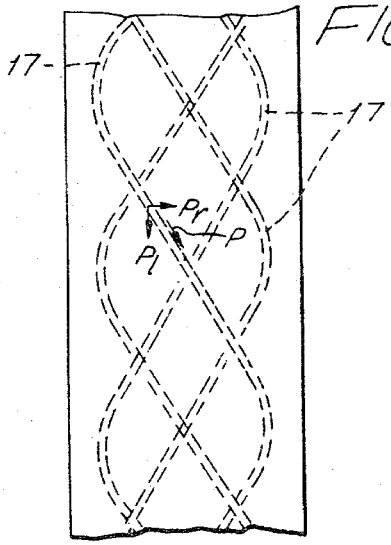
FIG. 9.
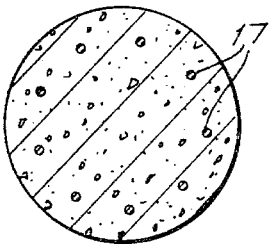

MARINE STRUCTURE

This application is a continuation-in-part of application Ser. No. 964,964, filed Nov. 20, 1978, which, in turn, was a continuation of Ser. No. 829,133, filed Aug. 30, 1977, both applications being abandoned.

The present invention is directed towards a marine structure. More particularly, but not exclusively, the invention is concerned with a marine structure from which for example drilling operations and or production of hydrocarbons may be conducted. The structure embodies a preferably floatable structure comprising at least one elastic column fixed to the sea bed. The present invention is also directed towards a method of building such a structure.

Present developments in the offshore oil and gas exploration have proved that the drilling for and the production of subaqueous mineral deposits will increase significantly in the near future and will be extended to sites further from shore at greater depths, or to sites where earthquakes are likely to occur or to areas where the load bearing capacity of the sea bed soil may be characterized as low. The production of hydrocarbons from these sites creates many new problems, not the least of which is that of reducing the imposed forces from the platform structure on to the sea bed to a level which the sea bed soil can withstand. In order to reduce the forces due to wind and wave action, imposed by the platform structure on to the sea bed it has been proposed to pivot an offshore drilling platform at its base to the sea bed in order to allow the platform to oscillate about the pivot. The platform consists of a base which is fixed to the sea bed and an upright tower pivoted to the base by means of a universal joint there between, the tower is kept stable by an uplift. When subjected to wave action the tower will sway linearily about the vertical, resulting in a bend at the pivot. Since such an articulated tower is designed for drilling for or the production of hydrocarbons, the platform is equipped with a plurality of conduits extending from the sea bed up to a deck structure above sea level. Due to the linerar swaying of the tower about the universal joint, producing a sharp bend at the joint, each conduit must be equipped with a mechanical joint of some sort. Failure may otherwise occur in the conduits due to excessive forces in the bend. Both the universal joint and the mechanical joint(s) in the conduits require frequent maintenance.

An articulated tower is an example of a so-called "soft" structure, another example being a tension-leg platform. A second group of offshore structures comprises stiff, rigid structures. Such a "stiff" structure has a first natural period shorter than the dominating wave period. Typical stiff structures are gravity platforms constructed of concrete as used in the North Sea, steel jackets and jack-ups. The dominating wave period referred to is in the range of 7 to 25 seconds. In contrast to a stiff structure, a "soft" structure has a first natural period which is longer than the dominating wave period.

The present invention is particularly suitable for use in offshore earthquake areas, for use in areas where the sea bed consists of soil having low load bearing capacity or for use in waters of great depths, for example depths exceeding 150 meters. The main object of the present invention is to provide a platform structure of a type imposing reduced forces on to the sea bed compared with a gravity structure designed for the same depth of waters and the same sea bed conditions.

A further object of the present invention is to provide a platform comprising a base which is intended to be founded to the sea bed and used as an anchor, at least one column rigidly connected to and extending up from the base and a buoyant structure rigidly connected to the at least one column.

It is still a further object of the present invention to provide a method of constructing such a platform structure.

According to the present invention the platform comprises a base intended to be fixed to the sea bed, at least one column rigidly connected to the base and a buoyant structure rigidly supported by the at least one column. The at least one column is preferably made of very high strength concrete and preferably with multiaxial prestressing. Both the base and the buoyant structure form a rigid body while the at least one column is formed as an elastic unit which is designed to deflect in a curved manner. The dimensions and elasticity of a platform structure according to the present invention are such as to result in a first natural period of the complete installed structure which is longer than the significant exciting wave periods (i.e., the dominating wave periods referred to above) whereby the structure, when subjected to environmental forces, will oscillate about the vertical producing a continual deflection of the at least one column, thereby behaving as an articulated column. The radius of curvature of the deflecting column is chosen so as not to produce excessive tensile/compressive forces in conductors/risers installed between the sea bed and the deck structure. In a preferred embodiment, the natural period in question is longer than thirty (30) seconds.

The deflection from the vertical at any section of the at least one column is given by the formulae:

$$\delta = \int (y) d\phi$$

where $\delta$ = deflection (y) = a function of the y-coordinates $\phi$ = angle of deflection from the vertical Further, the deflection from the vertical $\delta(y)$ of the at least one elastic column is a function of the following parameters:

$$\delta(y) = f(H, L, E\,I, \psi)$$

where

H = horizontal force occurring at top of the at least one column,

L = length of the at least one elastic column,

E I = the stiffness of the column, and $\psi$ = the angle resulting from forced rotation.

H is a calculated force dependent upon the equation of motion for the structure, while E I is dependent upon the designed shape of the at least one elastic column, taking into account the properties of the very high strength concrete used and the prestressing method used.

It should be appreciated that the forces imposed on to the sea bed by a platform structure in accordance with the present invention are dependent upon the flexibility of the at least one column. Thus an elastic column will impose reduced forces on to the sea bed compared with a rigid column.

By using at least one elastic column and by allowing the platform structure to sway under the influence of wave and wind action, the forces imposed on the sea bed will be greatly reduced compared with a gravity structure designed for the same depth of water. In addition, the weight of the structure may be levelled out by its buoyance, thereby producing no downwardly acting force on the sea bed. Thus, the platform solution according to the present invention is particularly suitable for use in areas where the sea bed soil has a low load bearing capacity. Further, due to the application of an elastic column, the present platform is also suitable for use in earthquake areas or arctic areas. The slender form of the structure makes it suitable for use in waters of great depth.

By using at least one elastic column which is designed to deflect in a curved manner without any sharp bends when subjected to environmental forces, the stresses produced along the curved section will be within reasonable limits. Thus a conventional riser/conductor system with no universal or mechanical joints, arranged around the column, may be used. In addition, due to the omission of such joints, maintenance work will be limited compared with a pivoted structure, and the installation work is simplified.

For a better understanding of the invention as well as other objects and further features thereof, reference is made to the following detailed description to be read in conjunction with the accompanying drawings wherein like components in the various views are identified by like reference numerals.

Figure 14:
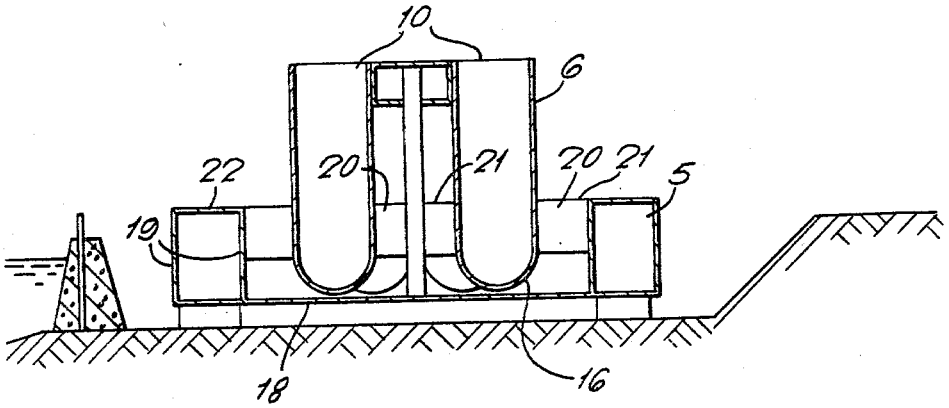
Figure 15:
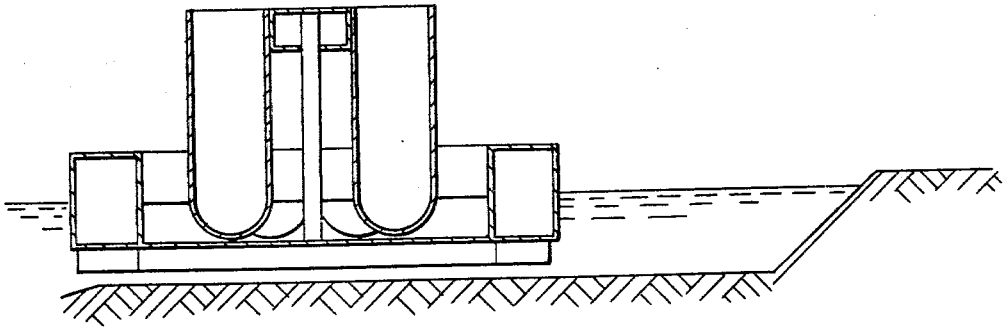
Figure 16:
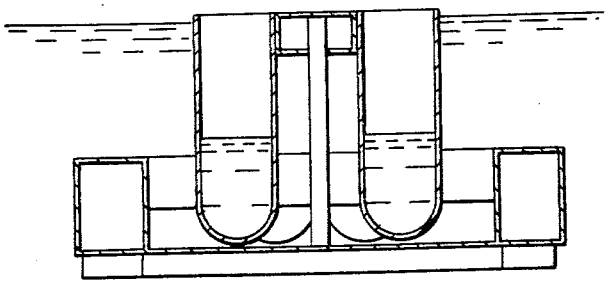

In the drawings:

FIG. 1 shows in principle a pivoted tower according to the prior art function,

FIG. 2 shows in principle an elastic column according to the present invention oscillating about the vertical, FIG. 3 shows a vertical section of one embodiment of the platform structure in accordance with the present invention, FIG. 4 shows a horizontal section of the base along lines C—C on FIG. 3, FIG. 5 shows a horizontal section of the buoyant structure along lines B—B on FIG. 3, FIG. 6 shows in principle a vertical section of one preferred way of prestressing the column multiaxially, FIG. 7 shows a horizontal section through the column shown in FIG. 6, FIG. 8 shows in principle a vertical section of a second preferred way of prestressing the column multiaxially, FIG. 9 shows a horizontal section through the column shown in FIG. 8, FIGS. 10 to 13 show in a schematic way various stages of a preferred method of construction, and FIGS. 14 to 16 show in a schematic way various stages of a second preferred method of construction.

FIG. 1 shows in principle an articulated tower 1 according to the prior art. The tower 1 is fixed to the sea bed 2 by means of a pivot or a hinge 3 and the tower 1 is designed to oscillate about its vertical equilibrium, as indicated by the dotted lines. The prior art tower 1 behaves as a rigid body which, when subjected to wave and wind action, will sway linearily about the vertical. The swaying results in a sharp bend at the pivot.

FIG. 2 shows in principle a platform 1 according to the present invention. The platform 1 is fixed to the sea bed and is designed to oscillate about its vertical equilibrium when subjected to wave and wind action. The main difference between the prior art structure and the structure according to the present invention is the means for allowing the oscillating motion. While the prior art uses a pivot, universal joint or the like 3, the present invention is based on at least one upright elastic column 4 rigidly founded to the sea bed 2, preferably through a base, and rigidly supporting a buoyant structure. As shown on FIG. 2 the at least one column 4 is designed to oscillate about its vertical equilibrium producing a continuous deflection along the at least one column 4 with a radius of curvature which does not produce excessive and prohibitive tensile/compressive stresses, for example in conductors/risers installed in vertical position around the column (not shown). The length of the column 4, is denoted by L, $\delta$ is the deflection, $\phi$ is the angle of displacement with respect to the vertical, $\psi$ is the angle resulting from forced rotation of the buoyant structure, and H is the horizontal force acting at the top of the at least one elastic column. The buoyant structure is designed to behave more or less as a rigid body.

It will be noted that the platform structure of the present invention differs from both the "soft" and stiff or rigid structures of the prior art. The differences between the invention and soft structures such as articulated platforms using a pivot, universal joint or the like have been discussed above. A critical difference between the invention and stiff or rigid structures such as gravity structures concerns the fact that latter are specifically designed to keep the oscillations thereof to a minimum. A reinforced concrete structure such as employed in the North Sea has a first natural period of oscillation of about 2 to 5 seconds, which is substantially less than the dominating wave period (which is in the range of 7 to 25 seconds). On the other hand, the dimensions and elasticity of the column of the invention are such as to produce a first natural period of the complete installed structure which is longer than the significant exciting wave periods so that the column deflects in a curved manner when the buoyant structure is subjected to environmental forces and the main structure oscillates about its vertical equilibrium when subjected to waves and wind, thereby behaving as an articulated column. As stated above, the structure preferably has a first natural period longer than 30 seconds.

FIG. 3 shows a vertical section through one preferred embodiment of a platform structure 1 according to the present invention. Basically, the embodiment on FIG. 3 comprises a rigid base 5, a column 4 rigidly fixed to and projecting up from the base 5, a buoyant structure 6, rigidly supported by the upper end of the column 4 and a deck superstructure 7 supported by the buoyant structure 6 above sea level 8. The base is founded to the sea bed 2, for example by means of one or more downwardly projecting and downwardly open skirts 9. The base 5 comprises a plurality of cells which serve as buoyancy means during transport of the structure, but which can be filled with ballast during submergence and penetration of the platform. The column 4 is rigidly fixed to the base 5 and extends up from it. The column 4 is solidly made of very high strength concrete and is preferably multiaxially prestressed. The column is designed and prestressed to deflect in an elastic manner as shown on FIG. 2. The buoyant structure 6 is rigidly supported by the elastic column 4 and comprises a plurality of longitudinal cells 10, at least one of which (11)

is lengthened to above sea level supporting the deck superstructure 7.

The non-lengthened cells 10 are preferably terminated at both ends by dome structures 12. As shown on FIGS. 3 and 5 the buoyant structure 6 consists of seven elongated and contiguous cells 10, 11 of concrete, each having a circular cross-sectional area. According to the embodiment shown on FIG. 3 only the central cell 11 is lengthened to project up above the seal level when the platform is founded on the sea bed. The central cell 11 contains an internally and concentrically arranged cell 13. The space between these two cells are designed to house the risers/conductors, if any, the inner cylinder 13 forming a utility shaft. The dotted lines 14 on FIG. 3 indicate the conductor/risers. These should be arranged as close to the elastic column 4 as possible.

According to the present invention the buoyant structure is preferably ballasted so as to produce a positive hydrostatic uplift, whereby the vertical load on the sea bed due to the weight of the platform may be almost cancelled out.

Two practical solutions of an elastic column which is multiaxial prestressed may be described as follows, referring to FIGS. 6 to 9.

The column may be formed as a solid column of very high strength concrete having a circular or polygonal cross-sectional area. The column may be prefabricated in conventional manner encasing the reinforcement and the prestressing cables, the latter being installed in ducts. Optionally, the column may be cast in situ.

FIG. 6 shows a vertical section through the at least one column, showing the vertical prestressing cables 15 and the radial prestressing cables 16. The cables 16 are arranged around the periphery of the column 4 and should be protected by a concrete layer or by a layer of for example epoxy, a mild steel tube, a rubber tube, or a combination of materials. It may be convenient to have a steel lining next to the concrete column and arranging the radial prestressing strands or cables outside this lining. To protect the strands or cables a protection as described above may be arranged outside the strands. The radial prestressing is not applied to the column until the column has obtained the required degree of compressive strength. The prestressing procedure may be as follows: Firstly, the radial prestressing is applied along the entire length of the column, whereafter the longitudinal cables are tensioned, and triaxial prestressing is obtained.

FIG. 8 shows a vertical section through the column 4 prestressed in a different manner. According to this method prestressing cables are arranged in spirals as shown on FIG. 8. When these spirals are tensioned, they will produce force components in both horizontal and vertical directions whereby a multiaxial prestressing effect is obtained.

FIGS. 10 to 13 show schematically the various stages of a preferred method of construction. As shown on FIG. 10 the base and the column are cast in a dry dock. The lower part 16 of the buoyant structure is cast on top of the base, simultaneously with the construction of the column. The lower part 16 rests freely on top of the base. It should be appreciated that the lower part at this stage is cast to a height which gives the completed lower part 16 sufficient buoyancy to float.

Figure 11:
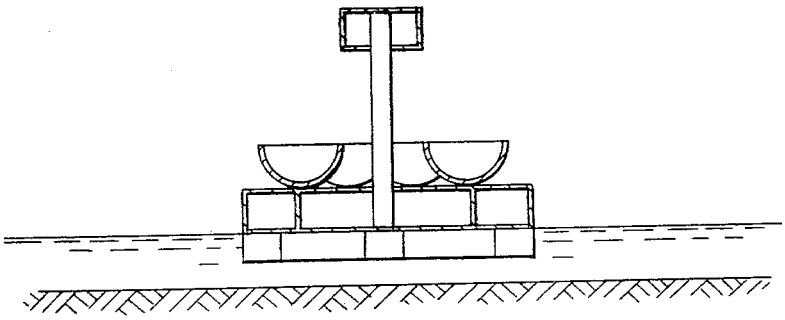

Water is then pumped into the dock and the completed raft is towed out of the dock to a deep water site as shown on FIG. 11.

By ballasting the base, the base will sink down to a predesigned depth leaving a section of the column above the sea level. The lower section of the buoyant body is floating during the submergence of the base.

Figure 12:
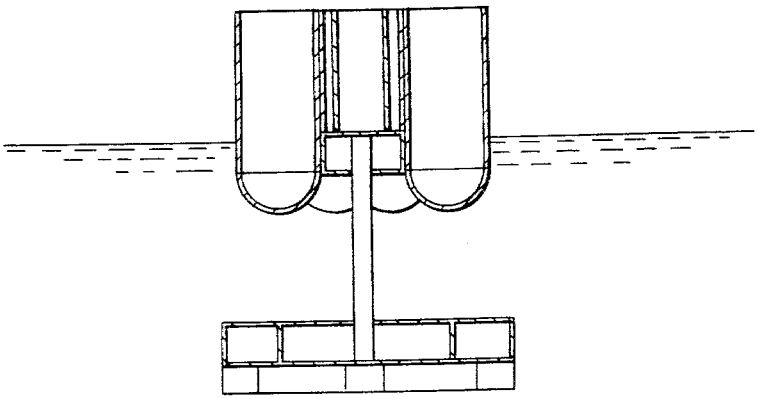
Figure 13:
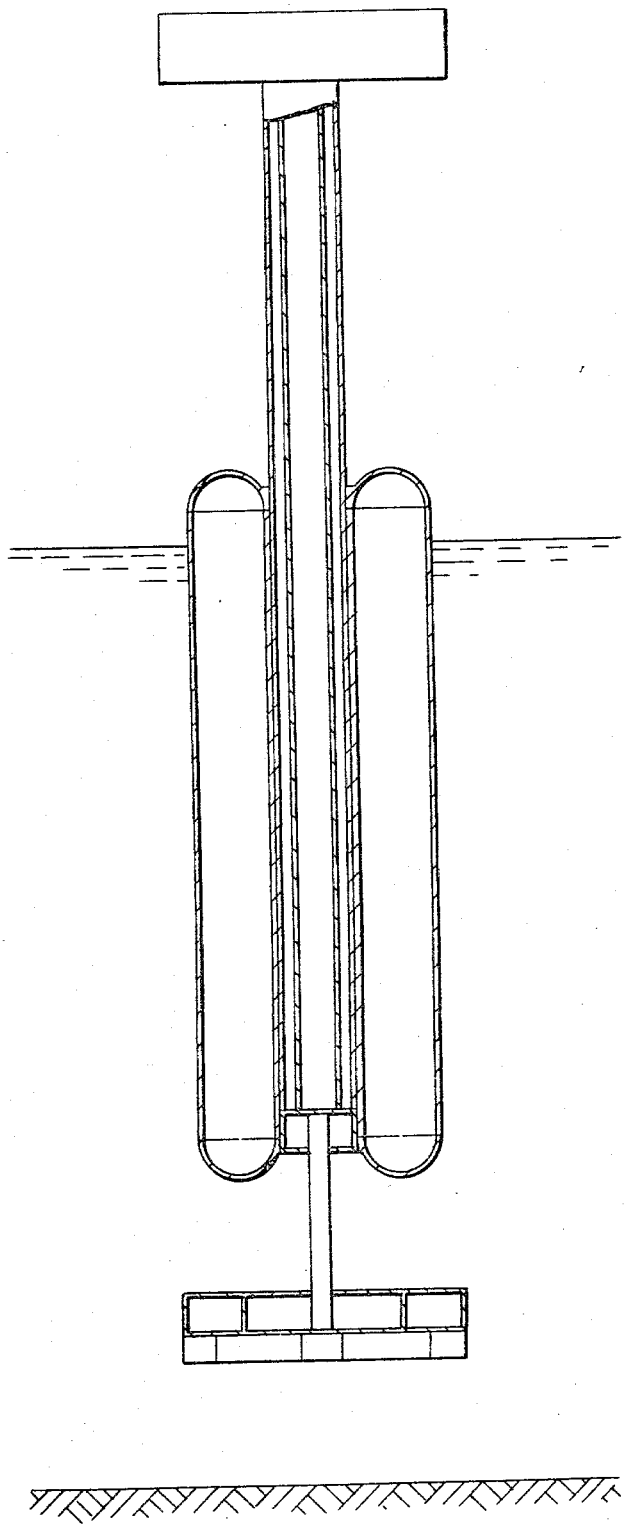

The lower section 16 is then towed into postion and connected rigidly to the upper end of the column 4, forming a body as shown on FIG. 12. The platform is then completed in any known manner, preferably by using the slipforming technique.

FIGS. 14 to 16 show schematically various stages of a second preferred method of construction. As shown on FIG. 14,the base 5, the column 4 and the lower part 16 of the buoyant structure 6 are cast in a dry dock. The lower part 16 of the buoyant structure, which is temporarily supported by the base 5, is cast simultaneously with the column 4 up to a height at least corresponding to the upper termination of the column. The lower part 16 is then rigidly connected to said upper termination of the column 4 and the temporary support is preferably removed. Water is then pumped into the dock and the raft is towed out of the dock to a deep water site as shown on FIG. 15, the base serving as buoyancy means during this stage. At the deep water site, the base is ballasted so that a change of floating position from the bottom structure to the cells is achieved (FIG. 16). The remaining part of the structure is thereafter completed in conventional manner.

The base 5 and the lower section 16 of the buoyancy structure according to the embodiment shown on FIG. 14 is slightly different from the embodiment shown on FIG. 3. The base comprises a base slab 18, two vertically arranged, concentrical walls 19 arranged around the periphery of the base and a ringformed top slab 22 on top of the two concentric walls thereby forming a cell structure peripherally arranged on the slab, and an open topped, central cell 20. Both the central cell and the base are divided into compartments by means of radial partitions or ribs 21. The lower end of the column 4 is rigidly connected to the base slab 18 and the radial partitions 21. The cells 10 of the buoyant structure may extend further down compared with the embodiment shown on FIG. 3.

Due to the above methods of construction, maximum compressive forces and maximum prestressing will occur immediately after the tensioning of the cables in the at least one column. Since the prestressing operations normally will be executed on the construction site, tests for function and strength are achieved prior to tow-out to the offshore field.

The embodiments shown and described above are formed with only one elastic column. It should be noted, however, that an elastic part comprising two or more elastic columns may be used. These may be arranged either in parallel or in series, i.e., in spaced relation in vertical direction of the column.

The elastic unit may for example consist of a plurality of multiaxial prestressed "mini"-columns, clustered together or spaced apart. These units may preferably, but not necessarily, be prefabricated. Alternatively, prefabricated concrete columns with unit or multiaxial prestressing may be used as prestressing members in the main elastic column.

It should be noted that in the previous discussions, multiaxial prestressing is assumed. If the forces acting on the structure are comparatively small, however, uniaxial prestressing may be used.

Further, the material used for construction is assumed to be concrete. However, steel or reinforced plastic or a combination of reinforced plastic, steel and concrete is indeed feasible without leaving the inventive idea.

Still further, in the above the structure is described as a platform suitable for the drilling for or the production of hydrocarbons. It should be appreciated, however, that the platform may be used as a mooring and loading buoy, as a lighthouse or for other functions.

On the embodiment shown on FIG. 3, the base consists of a caisson resting on the sea bed and founded by means of skirts. It should be appreciated, however, that the base may consist of a pile structure pressed or piled into the sea bed to form a more or less rigid support.

It should further be appreciated that the present invention is not limited to a buoyant structure as described in connection with FIG. 3. The buoyant structure may have any shape.

It is noted that the precise dimensions, elasticity and maximum deflection of the column or columns will vary with a number of variable parameters such as soil conditions, the depth at the operational site, the environmental forces at the operational site, the functional loading on the structure (e.g., the load on the deck or platform), the form of buoyant body employed and the buoyant capacity. A light high strength light aggregate concrete may be used, as required, in casting the column or columns. Such a concrete has a low E-modulus (Young's Modulus) as compared with conventional concrete.

We claim:

1. A marine structure comprising a base which is intended to be founded to the sea bed, at last one elastic prestressed column which is rigidly fixed to and extending up from the base and a buoyant, rigid structure comprising a submerged part and a part projecting up above the sea level to support a deck superstructure, the lower end of the submerged part being rigidly fixed to the upper end of the at least one elastic, prestressed column, the cross sectional area of the at least one elastic, prestressed column being substantially smaller than the cross sectional area of said lower end of the submerged part and the dimensions and elasticity of said column being such as to produce a first natural period of the complete installed structure which is longer than the significant exciting wave periods whereby said column will deflect in a curved manner when the buoyant rigid structure is subjected to environmental forces and the main structure will oscillate about its vertical equilibrium when subjected to waves and wind, thereby behaving as an articulated tower.

2. A marine structure as claimed in claim 1, wherein the structure has a first natural period longer than 30 second.

3. A marine structure as claimed in claim 1, wherein the at least one column is multiaxially prestressed.

4. A marine structure as claimed in claim 1, wherein the base comprises a plurality of rigidly interconnected cells.

5. A marine structure as claimed in claim 1, wherein the buoyant structure comprises at least one cell.

6. A marine structure as claimed in claim 3, wherein the multiaxial prestressing is achieved by vertical cables and circumferentially arranged cables.

7. A marine structure as claimed in claim 3, wherein the multiaxial prestressing is achieved by a plurality of vertical cables which are arranged in spirals.

8. A marine structure as claimed in claim 2, wherein the at least one column is fabricated of high strength, light aggregate concrete having a low Young's Modulus.

* * * * *